US009551192B2

(12) United States Patent
Deen

(10) Patent No.: US 9,551,192 B2
(45) Date of Patent: Jan. 24, 2017

(54) SOLID STATE WEAR TRACERS FOR DRILL BITS

(75) Inventor: Aron Deen, Fort Worth, TX (US)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 734 days.

(21) Appl. No.: 13/545,258

(22) Filed: Jul. 10, 2012

(65) Prior Publication Data

US 2013/0008717 A1 Jan. 10, 2013

Related U.S. Application Data

(60) Provisional application No. 61/506,151, filed on Jul. 10, 2011.

(51) Int. Cl.

| | |
|---|---|
| ***E21B 12/02*** | (2006.01) |
| ***E21B 47/00*** | (2012.01) |
| ***E21B 10/00*** | (2006.01) |

(52) U.S. Cl.

CPC ..... *E21B 12/02* (2013.01); *E21B 10/00* (2013.01); *E21B 47/00* (2013.01)

(58) Field of Classification Search

None

See application file for complete search history.

(56) References Cited

U.S. PATENT DOCUMENTS

| | | | | |
|---|---|---|---|---|
| 2,468,905 | A | 5/1949 | Warren | |
| 3,578,092 | A | 5/1971 | Tesch et al. | |
| 3,678,883 | A | 7/1972 | Fischer | |
| 3,818,227 | A | 6/1974 | Fries | |
| 4,030,558 | A * | 6/1977 | Morris | 175/39 |
| 7,400,257 | B2 | 7/2008 | Rivas | |
| 7,424,910 | B2 | 9/2008 | Xu et al. | |
| 2006/0099885 | A1* | 5/2006 | Lynde et al. | 451/5 |
| 2008/0012569 | A1* | 1/2008 | Hall | E21B 17/003 324/367 |
| 2009/0199618 | A1* | 8/2009 | Evrard | 73/19.09 |

* cited by examiner

*Primary Examiner* — Jennifer H Gay

*Assistant Examiner* — Caroline Butcher

(74) *Attorney, Agent, or Firm* — Hubbard Johnston, PLLC

(57) ABSTRACT

A method and apparatus for providing a reliable signal to the operator while drilling when a bit or tool becomes worn or damaged to a predetermined extent. The approach, in an exemplary embodiment, is to integrate one or more wear tracer elements into one or more parts of a drill bit or downhole tool that do not engage the earthen formation until the predetermined wear or damage occurs. At that time wear tracer elements are released upon wearing of the bit body, cutters, inserts, nozzles, or other components that include the wear tracer elements and enter the drill fluid. The presence of wear tracer elements in drilling fluid can be detected at the surface directly, or indirectly as a result of, for example, one or more reactions between the wear tracer elements and the mud, formation, or other subterranean elements, which yield some compound that may then be detected.

21 Claims, 8 Drawing Sheets

SOLID STATE WEAR TRACERS FOR DRILL BITS

CROSS REFERENCE TO RELATED APPLICATION

This application is based upon provisional application 61/506,151 filed on Jul. 10, 2011, which is incorporated herein by reference and the priority of which is claimed.

BACKGROUND OF THE INVENTION

1. Field of the Invention

This invention relates generally to drill bits for use in subterranean drilling, and in particular to methods and systems for assessing drill bit condition while drilling.

2. Background Art

It is difficult to determine the condition of drill bit components (including a dull bit) while drilling. Current methods for estimating the condition of drill bit components are based on measurement of rate of penetration, torque, and other surface parameters and comparison to predicted values of the parameters. However, unexpected operational or formational phenomena make parameter anomalies difficult to interpret reliably. This can result in premature trips for bits in good condition or delayed trips after unforeseen bit and tool damage.

3. Identification of Objects of the Invention

A primary object of the invention is to provide a method and apparatus that provides a reliable way to estimate the condition of drill bit components while drilling.

Another object of the invention is to provide a method and apparatus for that provides a reliable way to predict bit failure while drilling.

SUMMARY OF THE INVENTION

The objects described above and other advantages and features of the invention are incorporated in a method and a system that provides a reliable signal to the operator while drilling when a downhole bit or tool becomes worn or damaged to a predetermined extent. The approach, in an exemplary embodiment, is to integrate one or more wear tracer elements into one or more parts of a drill bit or downhole tool that do not engage the earthen formation until the predetermined wear or damage occurs. At that time wear tracer elements are released upon wearing of the bit body, cutters, inserts, nozzles, or other components that include the wear tracer elements and enter the drill fluid. The presence of wear tracer elements in drilling fluid can be detected at the surface directly, or indirectly as a result of, for example, one or more reactions between the wear tracer elements and the mud, formation, or other subterranean elements, which yield some compound that may then be reliably detected.

BRIEF DESCRIPTION OF THE DRAWINGS

The invention is described in detail hereinafter on the basis of the embodiments represented in the accompanying figures, in which.

DESCRIPTION OF THE PREFERRED EMBODIMENT OF THE INVENTION

Figure 1:
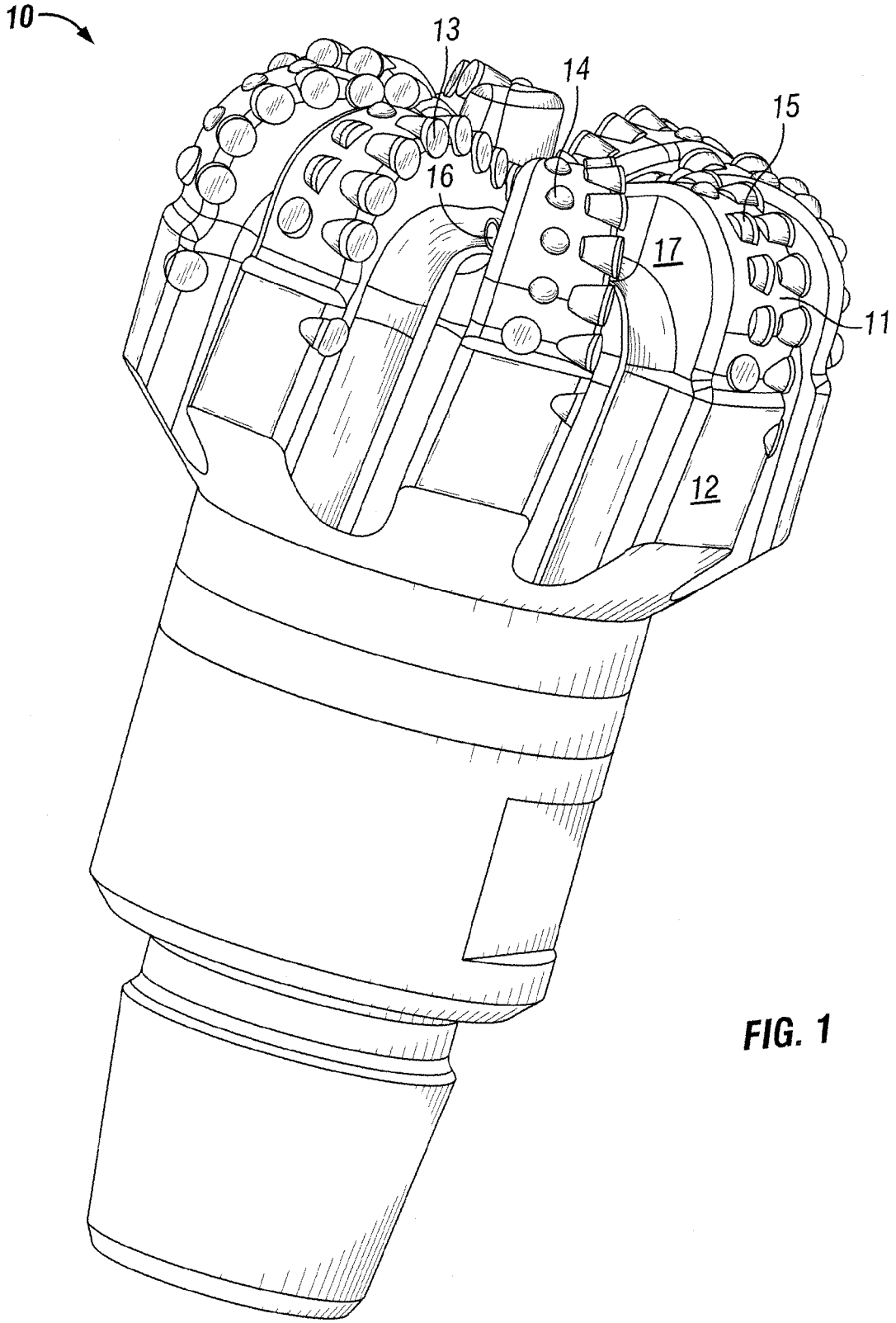
FIG. 1 is a perspective view of an exemplary drill bit according to a preferred embodiment of the invention, showing various drill bit components impregnated with solid state wear tracer elements, including, the bit body, cutter elements, and load limiters.
Figure 2:
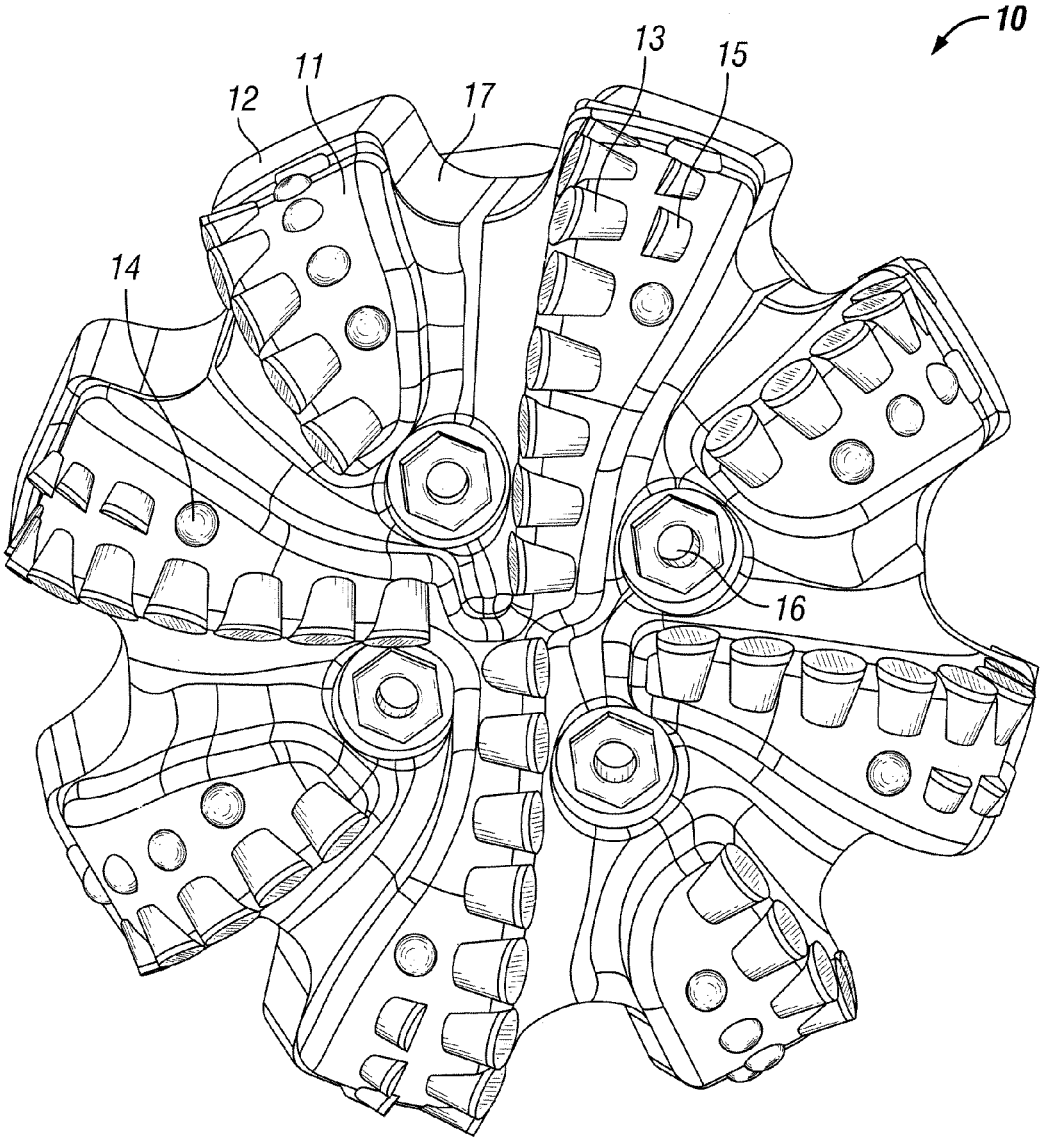
FIG. 2 is a plan view of the end, or face, of the drill bit of FIG. 1.

FIGS. 1 and 2 illustrate an exemplary drill bit 10 according to a preferred embodiment of the invention. Drill bit 10 has a bit body 17 that defines a gage region 12, one or more blades 11 carrying one or more cutters 13, and one or more nozzles 16. Bit 10 may also include other various drill bit components, such as one or more load limiters 14 and one or morel backup cutters 15.

The approach, in an exemplary embodiment, is to integrate one or more wear tracer elements into one or more parts of drill bit 10, including the above-mentioned drill bit components. The presence of wear tracer elements in drilling fluid can be detected directly or indirectly. The tracer elements are released upon wearing of the bit body, cutters, inserts, nozzles, or other components that include the wear tracer elements, thereby providing a reliable and traceable signal that removes the need for assumptions of bit and tool condition, improves decision consistency, and reduces non-productive time.

In a first embodiment, the wear tracer elements themselves are directly detectable in the drilling fluid. Alternatively, the wear tracer elements are indirectly detectable as a result of, for example, one or more reactions between the wear tracer elements and the mud, formation, or other subterranean elements, which yield some compound that may then be reliably detected.

In an exemplary embodiment, wear tracer elements include metals such as nickel, zinc, 10 silver, copper, or alloys thereof. In an alternative embodiment, wear tracer elements include radioactive elements such as various isotopes of Cesium (Cs), Americium (Am), Krypton (Kr), and isotopes thereof.

Figure 3A:
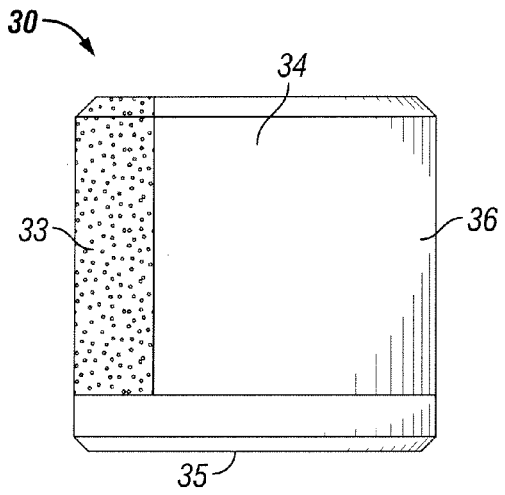
FIG. 3A is an elevational view of a longitudinal side of a cutter drill bit component for use with the exemplar drill bit of FIGS. 1 and 2 according to another embodiment of the invention, showing an axial section of the cutter insert behind the cutter table having wear tracer elements.
Figure 3B:
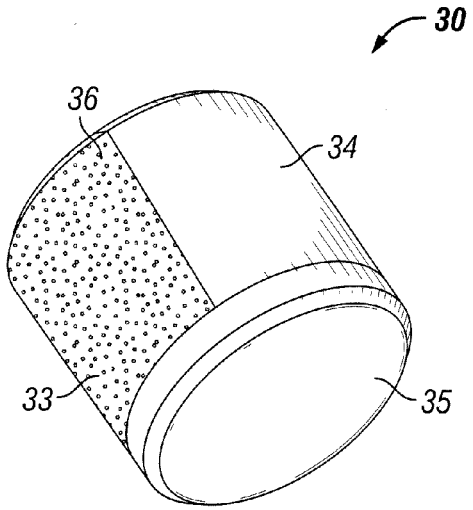
FIG. 3B is a perspective view of the cutter of FIG. 3A.

The tracer material in embodiments of the invention may be embedded into the drill bit components in a variety of ways. For example, FIGS. 3A and 3B depict alternative views of an exemplary cutter 30 with wear tracer elements, which may be any primary cutter 13 or back-up cutter 15 of bit 10. Cutter 30 includes a cutting surface, or table, 35 and a substrate 36. Cutting surface 35 may include polycrystalline diamond compact (PCD), thermally stable polycrystalline diamond component (TSP), or tungsten carbide (WC), for example. Substrate 36 includes a region 33 parallel to the longitudinal axis of cutter 30 is made of a material that includes wear tracer elements. The remainder 34 of substrate 36 is made of conventional material.

Figure 4A:
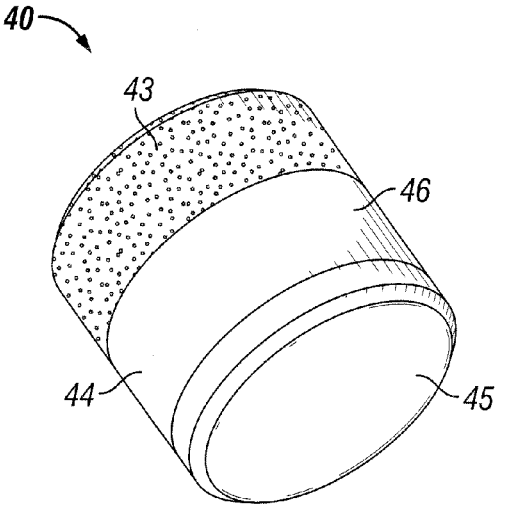
FIG. 4A is a perspective view of a cutter drill bit component for use with the exemplar drill bit of FIG. 1 according to another embodiment of the invention, showing an outer transverse section of the cutter insert made of conventional material disposed directly behind the cutter table and an inner transverse section of the cutter insert loaded with wear tracer elements.
Figure 4B:
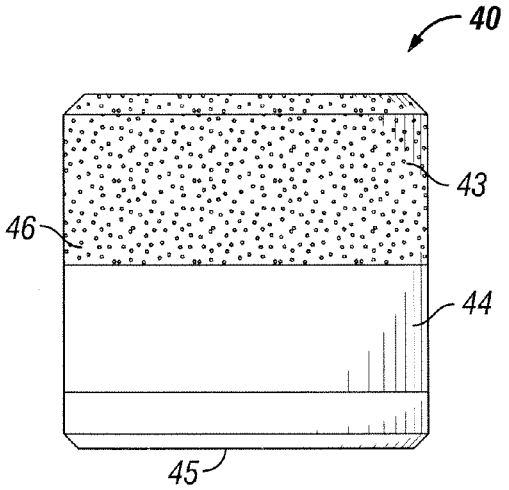
FIG. 4B is an elevation view of a longitudinal side of the cutter of FIG. 4A.

FIGS. 4A and 4B depict a cutter 40 with wear tracer elements according to another embodiment, which may be any primary cutter 13 or back-up cutter 15 of bit 10. As with cutter 30, cutter 40 includes cutting surface 45 and substrate 46. Substrate 46 has on outer cylindrical region 44, located just behind cutting table 45, that is made of conventional material and an inner cylindrical region 43 that is made of a material that includes wear tracing elements.

In alternative embodiments, not illustrated, the tracer-containing region may be transversely sandwiched between the cutter table and an inner region, or it could be a planar or cylindrical region defined on the longitudinal axis of the cutter, either centrally or asymmetrically, for example. Also, the wear tracer section could be a cylindrical shell or jacket that acts as a sleeve to the cutter substrate. These examples are not exclusive of other geometries. In addition, an entire substrate of a cutter may include wear tracer elements. All cutters 13, 15 in bit 10, or only a selective number of strategically placed cutters, may include wear tracer elements.

Regions of wear-tracer material and conventional material may be integrally formed, or they may consist of discrete inserts that are conjoined. Moreover, within the wear tracer regions, a gradient of tracer material can be used to show a graduated wear level rather than a binary measure at a given point. Gradients may be parallel to the cutter longitudinal axis, parallel to a cutter radius, or coaxial, for example.

Load limiters 14 are typically shaped and oriented on bit 10 slightly differently than are cutters 13, 15, but all of the mechanisms for adding a wear tracer material to a cutter element are also viable for load limiters.

Figure 5A:
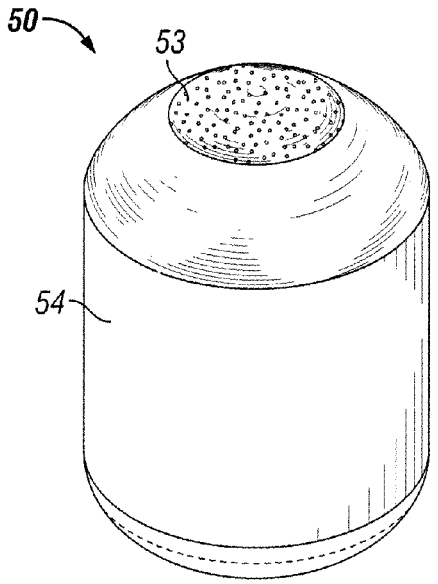
FIG. 5A is a perspective view of a load limiter drill bit component for use with the exemplar drill bit of FIGS. 1 and 2 according to a first embodiment, shown with a central hemispherically-tipped rod having wear tracer elements coaxially surrounded by a jacket of conventional material.
Figure 5B:
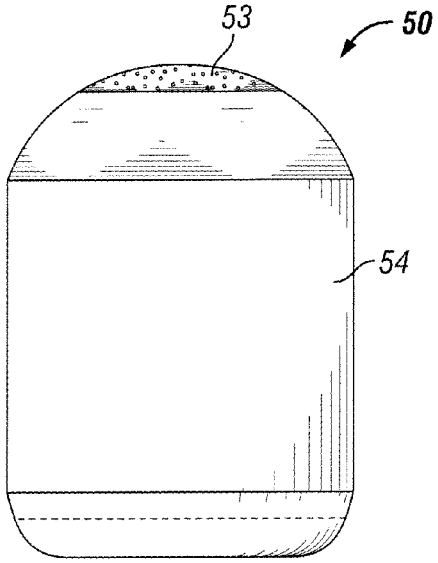
FIG. 5B is an elevation view of a longitudinal side of the load limiter of FIG. 5A.
Figure 6A:
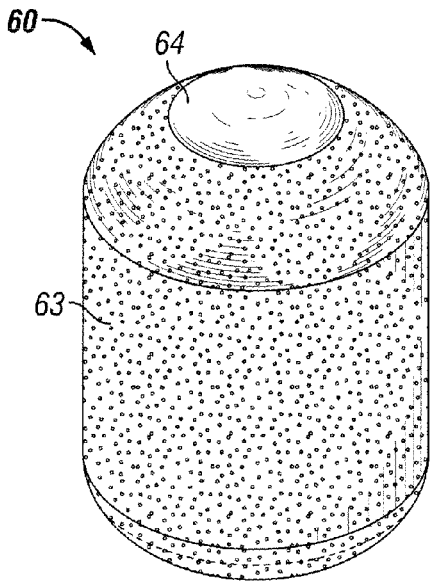
FIG. 6A is a perspective view of a load limiter drill bit component for use with the exemplar drill bit of FIGS. 1 and 2 according to a second embodiment, showing a hemispherically-tipped central rod of conventional material surrounded by a coaxial jacket having wear tracer elements.
Figure 6B:
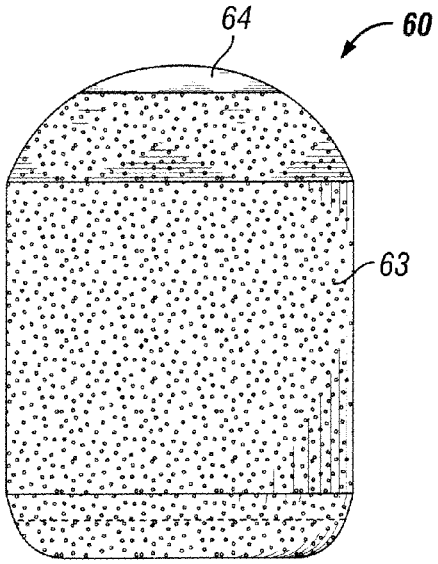
FIG. 6B is an elevation view of a longitudinal side of the load limiter of FIG. 6A.
Figure 7A:
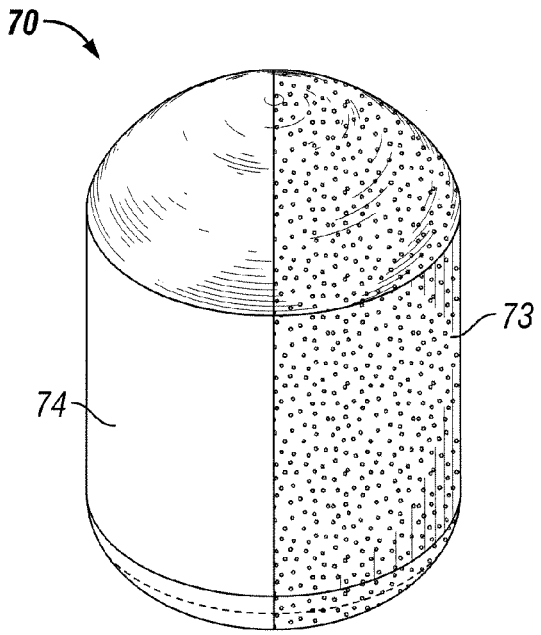
FIG. 7A is a perspective view of a load limiter drill bit component for use with the exemplar drill bit of FIGS. 1 and 2 according to a third embodiment of the invention, showing two axially-divided halves—one of conventional material and the other including wear tracer elements.
Figure 7B:
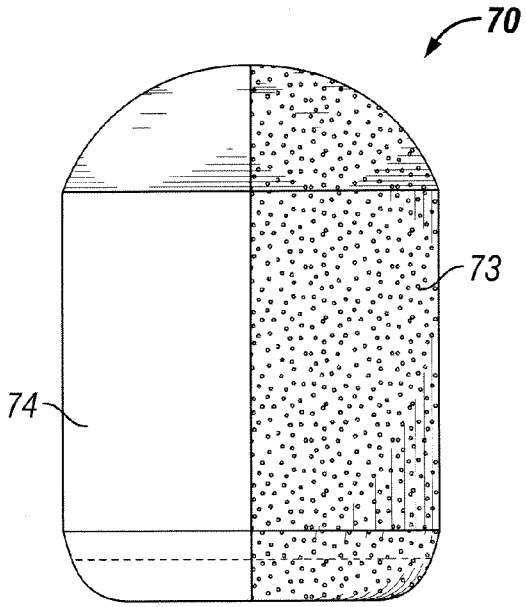
FIG. 7B is an elevation view of a longitudinal side of the load limiter of FIG. 7A.
Figure 8A:
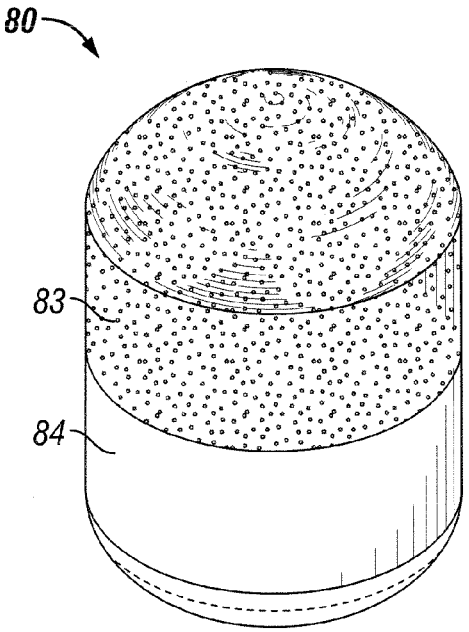
FIG. 8A is a perspective view of a load limiter drill bit component for use with the exemplar drill bit of FIGS. 1 and 2 according to a fourth embodiment of the invention, showing two transversely-divided sections—an outer hemispherically-tipped section, including wear tracer elements and an inner cylindrical section of conventional material.
Figure 8B:
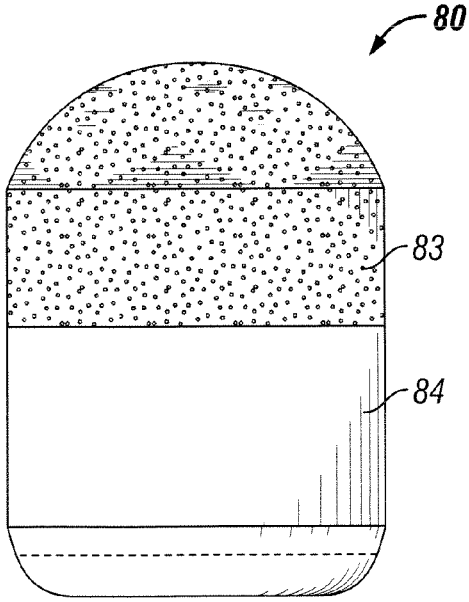
FIG. 8B is an elevation view of a longitudinal side of the load limiter of FIG. 8A.

For example, FIGS. 5A and 5B depict alternative views of an exemplary load limiter 50 in which a hemispherically-tipped rod 53 having wear tracer elements is centrally located along the longitudinal axis of load limiter 50. Rod 53 is coaxially surrounded by a sleeve 54 consisting of conventional material. FIGS. 6A and 6B depict alternative views of an exemplary load limiter 60 in which a central hemispherically-tipped rod 64 is made of conventional materials and a sleeve 63 coaxially surrounding rod 64 is made of a material that includes wear tracer elements. FIGS. 7A and 7B depict alternative views of an exemplary load limiter 70 in which a portion 74 of the load limiter body along the longitudinal axis is made of material including wear tracer elements, and the remaining portion 73 of the load limiter body is made of conventional material. Finally, FIGS. 8A and 8B depict alternative views of an exemplary load limiter 80 in which the outer hemispherical tip portion 83 of the load limiter is made of material embedded with wear tracer elements, and the remaining portion 84 of the load limiter body is made of conventional material.

Other suitable geometries, not illustrated, are also possible. For example, an entire load limiter insert may include wear tracer material. Regions of wear-tracer material and conventional material may be integrally formed, or they may consist of discrete inserts that are conjoined. Moreover, within the wear tracer regions, a gradient of tracer material can be used to show a graduated wear level rather than a binary measure at a given point. Gradients may be parallel to the cutter longitudinal axis, parallel to a cutter radius, or coaxial, for example. All load limiters 14 in bit 10, or only a selective number of strategically placed load limiters (such as on orthogonal axes), may include wear tracer elements.

Referring back to FIGS. 1 and 2, in addition to cutter elements 13, 15 and load limiters 14, other drill bit components may include wear tracer element-containing material. For example, bit body 17, or just portions of the bit such as one or more blades (or portion of blades) 11, gage region (or gage pads) 12, may be made of a wear tracer element material or be coated, brazed, or otherwise deposited with a wear tracing element alloy, for example. The material of bit body 17 (or portions thereof) could have wear tracer elements homogeneously dispersed throughout, or it could contain a gradient of wear tracer elements. Bit body 17 (or portions thereof) may also include discrete layers of wear tracing element-containing material or may include a component that serves as a dedicated tracer. Finally, other components, including nozzles or nozzle inserts 16, may include wear tracer elements.

The description of different configurations of wear tracer elements and conventional materials is not intended to be limiting but is intended to encompass any useful configuration comprising a wear tracer element or combinations of wear tracer elements in one or more dill bit components. A single drill bit may employ many different configurations of wear tracer elements and drill bit components so as to identify different patterns of wear on the drill bit. Similarly, it is understood that the person of ordinary skill will recognize numerous different ways in which wear tracer elements may be integrated, embedded, coated, mounted or otherwise affixed to drill bit components.

Operation of the Invention

The hardened tables at the front of the drill bit cutters 13 are all that are supposed to engage the formation, as designed. Any other part of the bit is specifically designed to engage the formation only after a specific depth of cut is exceeded or the cutting structure becomes damaged. At either of these points, these other components would engage formation, and it would be helpful to know when they do, as it usually indicates a wear level of the bit.

Figure 9A:
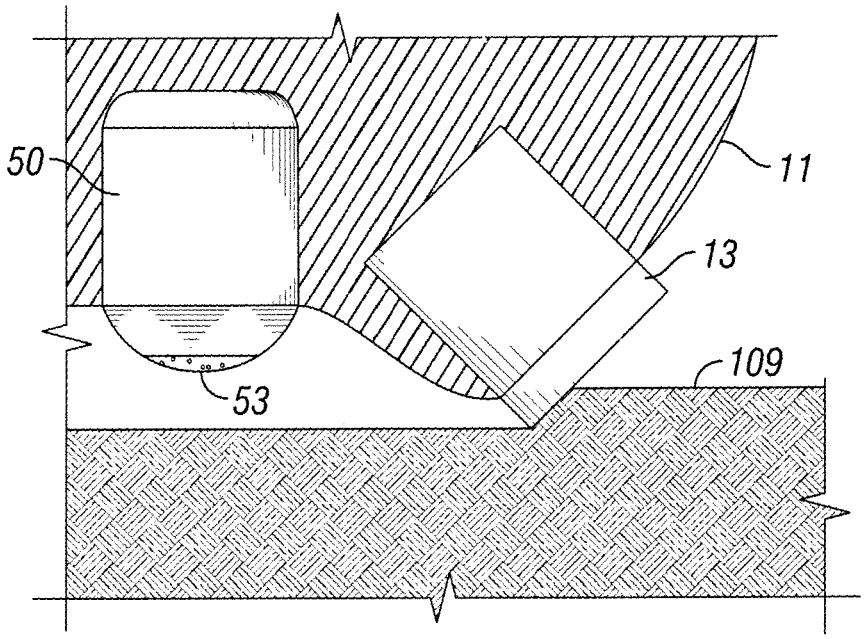
FIG. 9A is a cross-section view of a blade of the drill bit of FIGS. 1 and 2 to an embodiment of the invention during drilling, showing a cutter with minimal wear shearing earthen formation and a load limiter not engaging the formation.
Figure 9B:
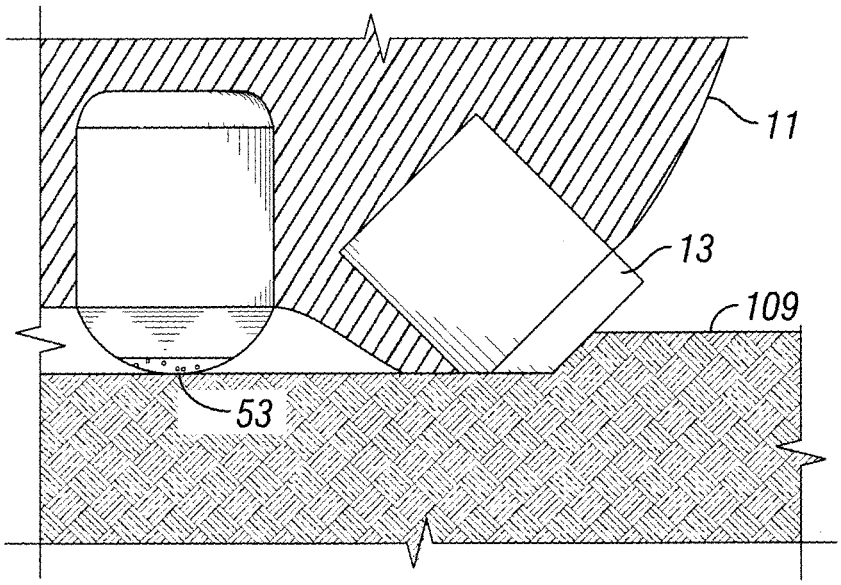
FIG. 9B is a cross-section view of the blade of FIG. 9A during drilling, showing a damaged or excessively worn cutter and a load limiter having wear tracer elements exposed to the formation for abrasion thereof and resulting introduction of wear tracer elements or their reaction byproducts into the drilling fluid.

FIGS. 9A and 9B illustrate a cutter 13 and a load limiter 50 within a blade 11 of a drill bit shearing a formation 109. Load limiter 50 includes a center rod 53 made of a material that includes wear tracer elements, as described above. In FIG. 9A, cutter 13 has little to no wear. Accordingly, load limiter 50 does not make contact with the formation 109. In operation, as the table of cutter 13 becomes damaged, either by impact failure or cumulative abrasion, the substrate of cutter 13 becomes increasingly exposed. At some point with continued drilling, the top of blades 11, load limiter 50, and other components may engage to the formation.

In FIG. 9B, cutter 13 is worn beyond the table so that cutter substrate is engaging the formation. Load limiter 50, which is designed to contact formation 109 when the wear on cutter 13 reaches a predetermined threshold, now also engages the formation. The wear tracer rod 53 of load limiter now abrades against the formation 109, causing wear tracer elements to enter the drilling fluid and to react with the formation 109.

Although FIG. 9B shows load limiter 50 as a wear tracer component, the substrate of cutter 13 and the tip of blade 11 are also suitable for containing wear tracing elements, as they also are engaging the formation 109. Indeed, any drill component that only engages the formation 109 once the cutting element 13 have worn or are damaged may include tracer elements.

Figure 10:
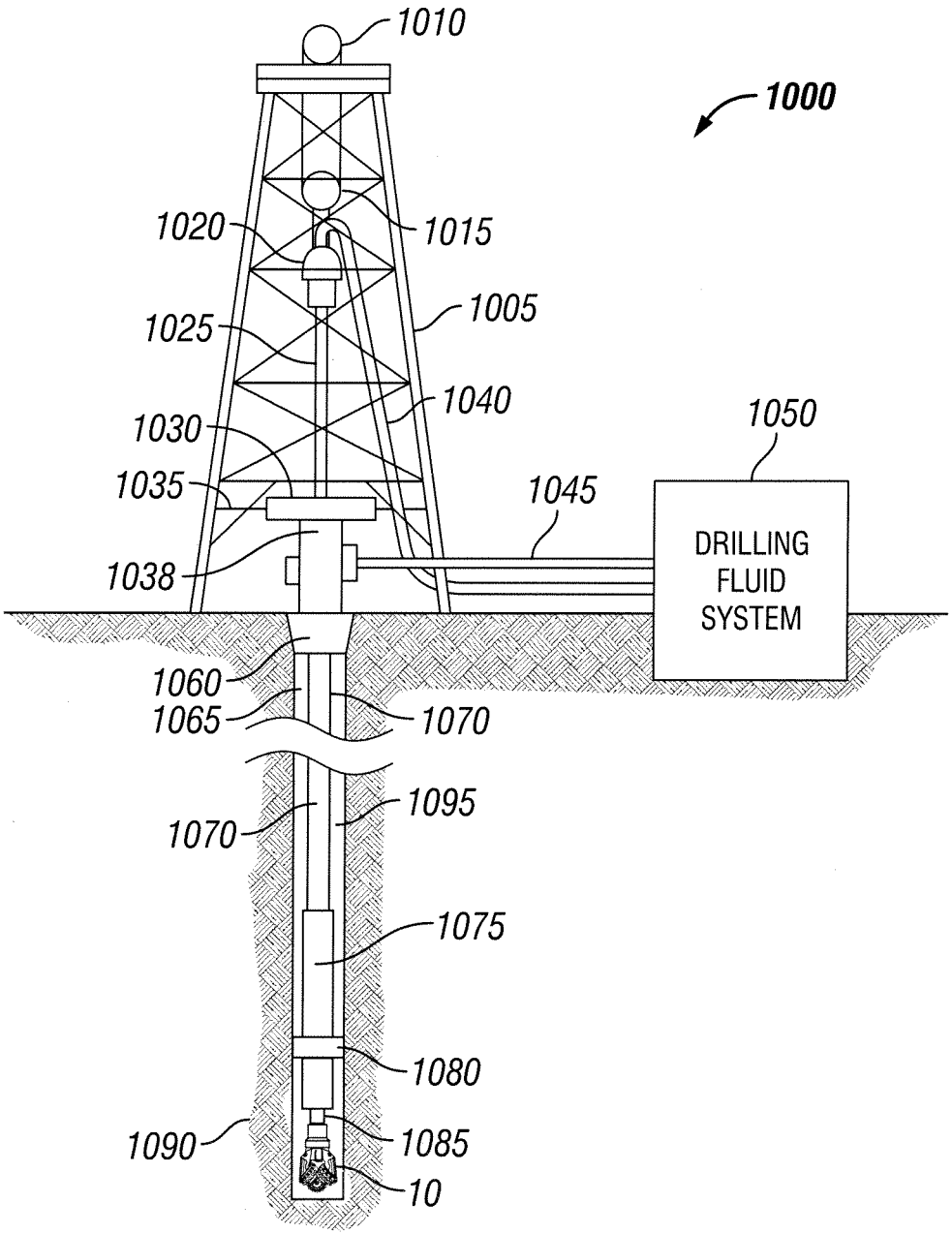
FIG. 10 is an elevation view of an exemplary subterranean drilling operation according to a preferred embodiment of the invention.
Figure 11:
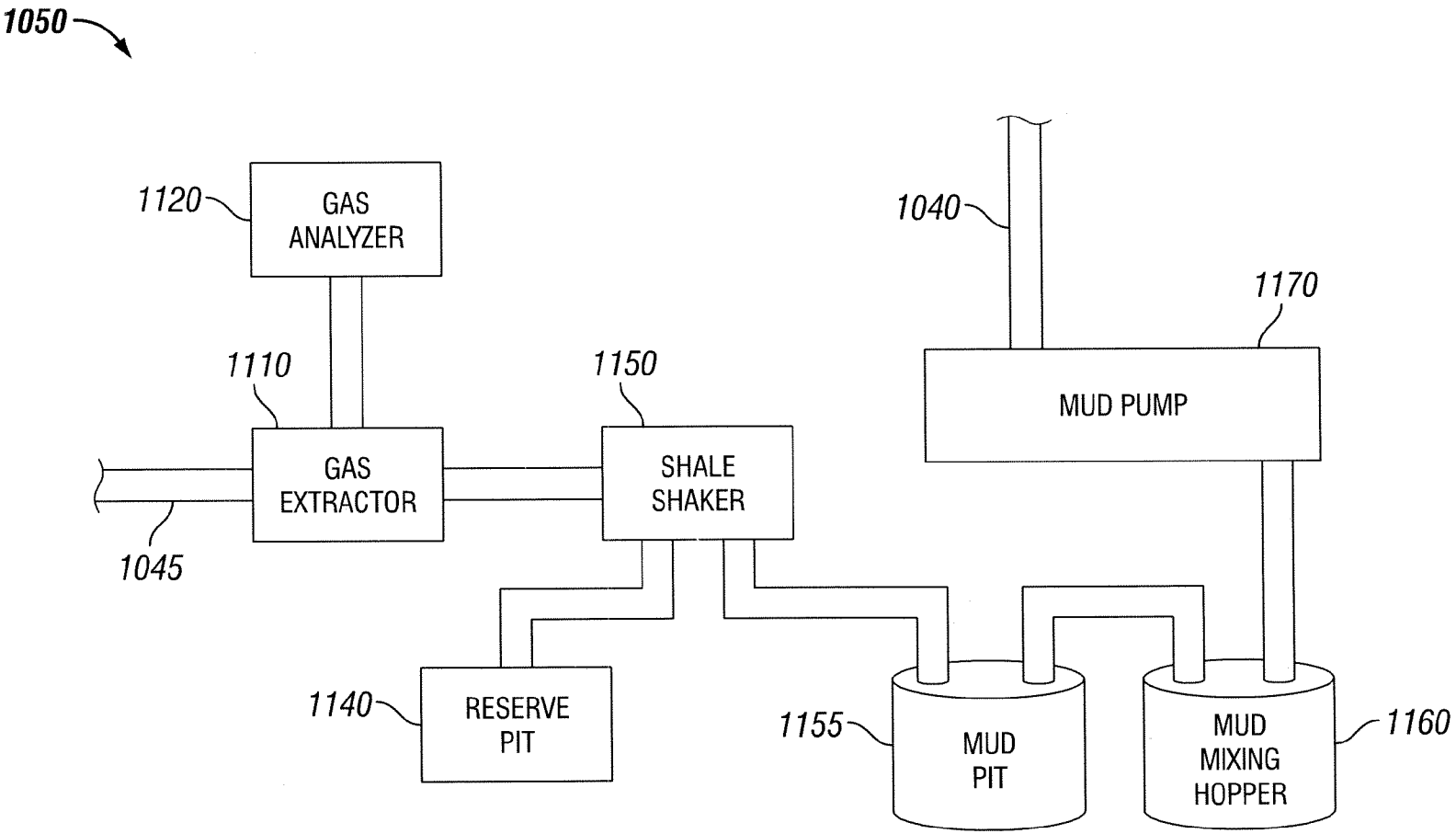
FIG. 11 is a functional block diagram of the drilling fluid system of FIG. 10 including instruments for detecting wear tracer elements according to an embodiment of the invention.

FIG. 10 illustrates the anatomy of an exemplary drilling operation 1000, including derrick 1005, draw works 1010, traveling block 1015, swivel 1020, kelly 1025, rotary table 1030 in drill rig floor 1035, blow out preventer 1038, casing head 1060, bore hole 1065, drill string 1070, bottom hole assembly 1075, stabilizer 1080, drill collar 1085, drill bit 10, formation 1090, and drilling fluid 1095, mud return line 1045, kelly hose 1040, and drilling fluid system 1050. FIG. 11 depicts an exemplary drilling fluid system 1050 according to an embodiment of the invention, including mud return line 1045, gas extractor 1110, gas analyzer 1120, shale shaker 1150, reserve pit 1140, mud pit 1155, mud mixing hopper 1160, mud pump 1170, and kelly hose 1040.

Referring to both FIGS. 10 and 11, during operation of the drilling rig, drilling fluid, or mud, is pumped by mud pump 1170 through kelly hose 1040 through drill string 1070 and drill bit 10. Drilling fluid 1095 is forced through nozzle 16 (FIG. 1) on drill bit 10 and is pumped through borehole 1065 back to the surface and is returned to drilling fluid subsystem 1050 via mud return hose 1045. The drilling fluid 1095 that circulates back to the surface includes cuttings from formation 1090, abraded components of drill bit 10 and other byproducts of drilling.

Drilling fluid 1095 that is circulated to the surface also includes wear tracer elements that have abraded from one or more components of drill bit 10 and reaction byproducts of one or more reactions involving a wear tracer element. One such reaction is a reaction between a wear tracer element and the drilling fluid 1095. Other such reactions include a reaction between a wear tracer element and the subterranean formation, between a wear tracer element and abraded PCD elements, and between a wear tracer element and other subterranean elements.

The drilling fluid 1095 that is returned to the surface flows through mud return hose 1045 into gas extractor 1110. Gas extractor 1110 is, in a preferred embodiment, a conventional mud gas separator including a vertical column used for physical phase separation of gas from the liquid mud. Mud is pumped into the column, which is basically an engineered void space where the gas can exit the liquid naturally, and the gas comes out at the top, the mud, less the gas, at the bottom. This is done so that any flammable gas can be pushed away from the rig to safely flare.

Gas analyzer 1120 constantly samples the gas from gas extractor 1110 to measure the gas components coming out of the top. Gas analyzer 1120 can be any analytical instrument that can directly detect wear tracer elements or indirectly detect wear tracer elements by directly detecting reaction byproducts of reactions involving wear tracer elements. In an embodiment, gas analyzer 1120 is a mass spectrometer configured to detect Hydrogen gas ($H_2$) such as the DQ1000™ commercially available through Crown Geochemistry. Gas analyzer 1120 is then used to detect a hydrogen spike, and the hydrogen spike indicates that one or more drill bit components have worn down to the wear tracer elements. In this particular embodiment, detected hydrogen is a measurable byproduct of wear as opposed to the wear tracer element itself.

Without being limited by theory, it is believed that hydrogen gas may be released by some high temperature reaction (in the range of 600-1200 degrees centigrade) with a wear tracer element at high pressures such as those associated with subterranean drilling. There is a base level of $H_2$ in formation, but it is small. Wear tracer elements (e.g., nickel, zinc, silver, or copper) serve as a catalyst to release hydrogen from the drilling environment (probably drilling fluid) at high temperatures. When a catalytic material reaches high heat, $H_2$ is released in gas phase and is readily detected by the mass spectrometer. Conventional methods today use mass spectroscopy for hydrocarbon analysis, but not for measuring byproducts of wear.

In another embodiment of the invention, the downhole wear tracer element includes one or more radioisotopes, and the drilling fluid system includes a detector calibrated for measuring the presence of the wear tracer radioisotopes.

Therefore, according to one or more embodiment of the invention, when a bit or tool becomes worn or damaged to a measurable extent, a reliable signal is available to the operator. This method and system may prevent some expense incurred by running a tool past its life and improve overall performance by limiting non-productive time from operating with damaged equipment. Further, when rate-of-penetration, torque, or other parameter anomalies appear, the lack of a reliable wear/failure signal according to the invention suggests that the anomaly is not bit/tool related but more likely formation related. Accordingly, decision-making is improved.

The invention is also not limited to drag-style drill bits. For example, roller cone drill bits include bearings, leg protection inserts, gage inserts, and diamond-enhanced gage inserts, any of which can include wear tracer elements that could be used to detect wear. Some roller cone journal bearings have a nickel-silver bearing sleeve that, when a seal fails, is exposed to high heat and the drilling mud which, in an embodiment, yield measurable byproducts of wear in the form of a hydrogen spike.

As another example, referring to FIG. 10, a stabilizer 1080, for example, a stabilizer sub in bottom hole assembly 1075, can include wear tracer elements to indicate off-center or unstable wear patterns. Similarly, wear tracer elements can be used in any down-hole sub to identify bent sub components. Wear tracer components can also be integrated in rotary steerable system components, metal seals, metal bearings, and bearing components (including thrust bearings in down hole tools such as motors, rotary steering systems, and turbines).

The Abstract of the disclosure is written solely for providing the United States Patent and Trademark Office and the public at large with a way by which to determine quickly from a cursory reading the nature and gist of the technical disclosure, and it represents solely a preferred embodiment and is not indicative of the nature of the invention as a whole.

While some embodiments of the invention have been illustrated in detail, the invention is not limited to the embodiments shown; modifications and adaptations of the above embodiment may occur to those skilled in the art. Such modifications and adaptations are in the spirit and scope of the invention as set forth herein:

What is claimed is:

1. A system for evaluating drill bit condition during subterranean formation drilling, comprising: a drill bit adapted for coupling to a drill string and including at least one cutting element and a wear tracing element; a drilling fluid; and a wear tracer sensor, wherein the wear tracer sensor is configured to detect wear in the drill bit by detecting in the drilling fluid a chemical reaction byproduct of the wear tracing element with the drilling fluid.

2. The system of claim 1 wherein: said wear tracing element is included in at least one drill bit component and the at least one drill bit component is selected from the group consisting of the at least one cutting element, a bearing component, a bit body, a hard facing, a coating, a brazing filler, an insert, a cutter substrate, a nozzle, and a blade.

3. The system of claim 1 wherein: the wear tracing element includes at least one of the group consisting of nickel, zinc, silver, copper, and any alloy thereof.

4. The system of claim 1 wherein: the wear tracer sensor is adapted and configured to directly detect a reaction of the wear tracing element.

5. The system of claim 4 wherein: the reaction comprises a reaction between the wear tracing element and a subterranean element.

6. The system of claim 4 wherein: the reaction comprises a reaction between the wear tracing element and the drilling fluid.

7. The system of claim 1 wherein: the wear tracer sensor includes a gas analyzer.

8. The system of claim 7 wherein: the wear tracer sensor includes a mass spectrometer.

9. The system of claim 1 wherein the wear tracing element that reacts is a solid state wear tracing element.

10. A system for evaluating down-hole tool condition during subterranean formation drilling, comprising: a down-hole tool adapted for coupling to a drill string, the down-hole tool comprising a down-hole tool component with a wear tracing element; a drilling fluid; and a gas analyzer, wherein the gas analyzer is configured to detect wear in the down-hole tool component by detecting a chemical reaction byproduct of the wear tracing element in the drilling fluid.

11. The system of claim 10 wherein: the down-hole tool is a drill bit.

12. The system of claim 10 wherein: the down-hole tool is a stabilizer, motor, or rotary steering system.

13. A system for evaluating downhole tool condition during subterranean formation drilling, comprising:

a downhole tool adapted for coupling to a drill string and including a tool component with a wear tracing element;

a drilling fluid; and a wear tracer sensor, wherein the wear tracer sensor is configured to detect wear in the tool by detecting the a chemical reaction byproduct of the wear tracing element in the drilling fluid and the tool component is selected from one of the group of a cutter, a nozzle, a duct, a tool body material, a blade and a load limiter.

14. The system of claim 13 wherein the wear tracing element includes at least one of the group consisting of nickel, zinc, silver, copper, and any alloy thereof.

15. The system of claim 13 wherein the wear tracer sensor is adapted and configured to directly detect a reaction of the wear tracing element.

16. The system of claim 15 wherein the reaction comprises a reaction between the wear tracing element and the drilling fluid.

17. The system of claim 13 wherein the downhole tool is a bit.

18. The system of claim 13 wherein: the wear tracing element that reacts is a solid state wear tracing element.

19. A method for detecting wear in a downhole tool for advancing a borehole comprising:

including a wear tracing element within material forming a component of the tool selected from the group of a cutter, a nozzle, a blade and a load limiter;

releasing into a drilling fluid the wear tracing element in response to a threshold of wear; and detecting a byproduct of a chemical reaction of the wear tracing element with the drilling fluid.

20. The method of claim 19 wherein the wear tracing element includes at least one of the group consisting of nickel, zinc, silver, copper, and any alloy thereof.

21. A method for detecting wear in a downhole tool for advancing a borehole comprising:

dispersing a wear tracing element in the material of a wear element of the tool;

releasing into a drilling fluid the wear tracing element in response to a threshold of wear; and detecting a byproduct of a chemical reaction of the wear tracing element with the drilling fluid.

* * * * *